United States Patent [19]

Bennett

[11] 4,212,416

[45] Jul. 15, 1980

[54] FINE TUNE ADJUSTING MECHANISM FOR TANDEM-OPERATED FILLING UNITS OF A FILLING MACHINE

[75] Inventor: Richard N. Bennett, Arbutus, Md.

[73] Assignee: National Instrument Company, Inc., Baltimore, Md.

[21] Appl. No.: 912,417

[22] Filed: Jun. 5, 1978

[51] Int. Cl.[2] ..... B65B 3/04

[52] U.S. Cl. ..... 222/267; 222/134; 222/309; 403/3

[58] Field of Search ..... 92/13.3, 13.5, 13.7; 141/84, 183; 222/134, 135, 309, 267, 275; 417/429; 74/586; 403/3, 4

[56] References Cited

U.S. PATENT DOCUMENTS

| | | | |
|---|---|---|---|
| 2,032,163 | 2/1936 | Bagby | 222/309 X |
| 2,807,213 | 9/1957 | Rosen | 417/429 X |
| 3,237,661 | 3/1966 | Rosen | 141/180 |
| 3,246,604 | 4/1966 | Brailsford | 92/13.7 X |
| 4,077,441 | 3/1978 | Rosen et al. | 53/201 |

*Primary Examiner*—David A. Scherbel

*Attorney, Agent, or Firm*—Craig & Antonelli

[57] ABSTRACT

A fine adjusting mechanism for a number of individual filling units of a high-speed filling machine, operated in tandem from a common drive, which provides an adjustable lost motion between a common drive bar and the pivotal connection with the piston rod of a respective filling unit; the lost motion is adjustable by screwing an adjusting member more or less into the path of the sliding movements of a bearing member sliding in an elongated slot of a swivel member.

5 Claims, 4 Drawing Figures

FINE TUNE ADJUSTING MECHANISM FOR TANDEM-OPERATED FILLING UNITS OF A FILLING MACHINE

The present invention relates to a fine-tune adjusting mechanism for tandem-operated filling units of a high-speed filling machine.

Filling machines in which a certain number of relatively small containers such as bottles, ampoules, etc. conveyed on an endless continuously moving conveyor are to be simultaneously filled from nozzles adapted to be lowered into the containers are known in the art, for example, as described in the prior U.S. Pat. No. 2,807,213. These prior art filling machines utilize filling units as described, for example, in the U.S. Pat. No. 2,807,213 which are equipped with adjusting means 79, 101 for adjusting the amount dispensed during each discharge stroke by a respective filling unit by changing the eccentricity of the eccentric drive thereof. While this arrangement is quite satisfactory when each filling unit is driven individually and separately by a drive of its own, usually by the use of an eccentric drive as shown in the U.S. Pat. No. 2,807,213, such adjusting mechanism becomes inadequate when two or more filling units are driven in tandem from the same eccentric drive or drives, as described in U.S. Pat. No. 4,077,441 issued on Mar. 7, 1978, in the name of Sidney Rosen and Richard Nelson Bennett, entitled "Convertible Filling Machine", the contents of which are incorporated herein by reference.

More specifically, with the use of a convertible filling machine, as described in the aforementioned patent, the pre-existing adjusting mechanism is interposed between a respective eccentric drive and the common drive bar so that each filling unit can no longer be individually adjusted with respect to the amount discharged during its discharge stroke by changing the eccentricity of the eccentric drive.

The present invention is therefore concerned with the task to avoid the aforementioned shortcomings and to provide a fine-tune adjusting mechanism which can be readily interposed between the common drive bar and the lower swivel connection of each filling unit and which permits by extremely simple and relatively inexpensive means a fine-tune adjustment of each filling unit after an overall adjustment has been made by the use of the pre-existing adjustment mechanism in the eccentric drive which affects all filling units driven from the eccentric drive in the same sense.

The underlying problems are solved according to the present invention in that the lower swivel connection between the common drive bar and the lower end of an individual piston rod includes a swivel member pivotally connected with the lower end of the piston rod and provided with an elongated slot, which slidingly receives a bearing member connected with the common drive bar within the elongated slot, whereby a fine-tune adjustment screw is adapted to be screwed more or less far into the elongated slot and therewith into the path of sliding movement of the bearing member to permit fine-tune adjustments of the piston stroke of a given filling unit during one rotation of the eccentric by varying the amount of lost motion between the bearing member and the swivel member. A lock nut is provided to hold the adjusting screw in its selected position and to preclude unintended changes during operation.

The fine-tune adjusting mechanism of the present invention is not only simple in construction and relatively inexpensive in manufacture and assembly but also permits a fine adjustment of each filling unit individually by extremely simple means, requiring only relatively few additional parts.

By the use of the fine adjusting mechanism of the present invention, it is possible to "fine-time" each filling unit individually to assure identical filling amounts in all containers to be simultaneously filled during a given cycle of the filling machine. This is important, for example, in the pharmaceutical industry where the exact amounts filled into a container may be of importance.

Additionally, the fine-time adjusting mechanism according to the present invention will permit also relatively unskilled operators to perform the necessary adjustments without the need of special skills or special expertise.

Accordingly, it is an object of the present invention to provide a fine adjusting mechanism for tandem-operated filling units of high-speed filling machines which avoids by simple means the aforementioned shortcomings and drawbacks encountered in the prior art.

Another object of the present invention resides in a fine-tuning adjusting mechanism for individual filling units driven in unison from a common drive which is simple in construction and relatively inexpensive in manufacture and assembly and which can be operated also by relatively unskilled personnel.

A further object of the present invention resides in a fine-time adjusting mechanism of the type described above which permits extremely precise and fine adjustments of the amount discharged during each discharge stroke of each individual filling unit of several tandem-operated filling units.

Still another object of the present invention resides in a fine adjusting mechanism of the type described above which is highly reliable in operation, yet offers ease of handling under all operating conditions.

Still a further object of the present invention relates to a fine adjusting mechanism for tandem operated filling units which can be made available with the parts necessary to convert a conventional machine to tandem operation or can be installed subsequently into machines already converted for tandem operation.

These and other objects, features and advantages of the preseent invention will become more apparent from the following description when taken in connection with the accompanying drawing which shows, for purposes of illustration only, one embodiment in accordance with the present invention, and wherein.

Figure 1:
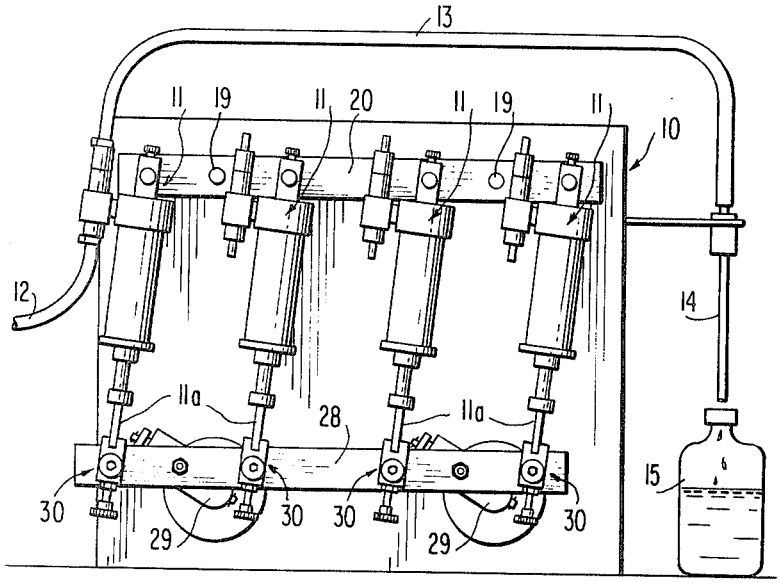
FIG. 1 is a somewhat schematic elevational view of a filling machine including several filling units operated in tandem and provided with a fine adjusting mechanism in accordance with the present invention.
Figure 2:
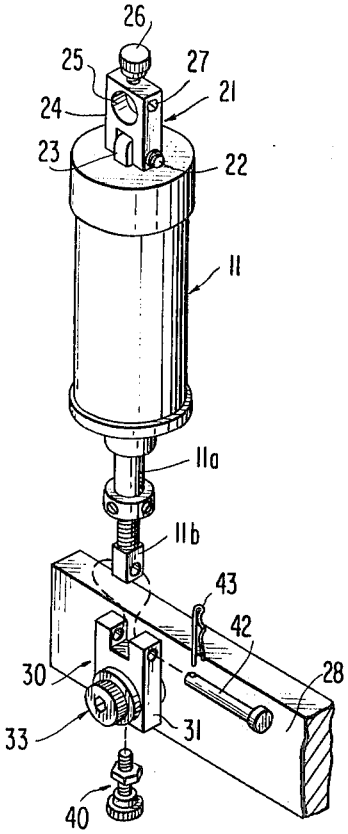
FIG. 2 is a perspective view showing one filling unit and its connection with the common drive bar by means of a fine adjusting mechanism in accordance with the present invention.

Referring now to the drawing wherein like reference numerals are used throughout the various views to designate like parts, FIG. 1 illustrates a conventional four-pump filling machine generally designated by reference numeral 10 which has been converted for tandem operation as disclosed in the aforementioned U.S. Pat. No. 4,077,441 and which includes four individual filling units 11 each provided with a piston rod 11*a* and a connecting member 11*b* (FIG. 2) threadably connected to the lower end of the piston rod and provided with a transverse bore. Each filling unit 11 of the filling machine 10 includes an intake line 12 from a supply tank (not shown) and a discharge line 13 leading to a discharge or filling nozzle 14 adapted to reciprocate for lowering into the container 15 prior to the discharge stroke and for raising upon completion of the discharge stroke to permit the container to move away from the filling station, as described more fully, for example, in the prior U.S. Pat. Nos. 3,067,768 and 3,237,661. Since the filling machine, as such, is of conventional construction, only those parts are illustrated herein which are believed necessary for an understanding of the present invention. Moreover, the number of individual filling units 11 may, of course, also vary from installation to installation.

Each filling unit 11 is pivotally connected at its upper end on an upper mounting bar 20 by way of an upper swivel assembly generally designated by reference numeral 21 (FIG. 2) while the upper mounting bar 20 itself is fastened onto the pre-existing mounting pins 19 associated with the pre-existing individual eccentric drives used for individually driving a filling unit, as more fully described in the aforementioned U.S. Pat. No. 4,077,441. The upper swivel assembly 21 is pivotally connected by the use of a swivel pin 22 to a lug 23 fixed to the end cover of the filling unit 11. The swivel assembly 21 is mounted on a corresponding mounting member provided on the upper mounting bar 20 by means of the aperture 25 and a thumbscrew 26 held in place by a set screw 27.

Figure 3:
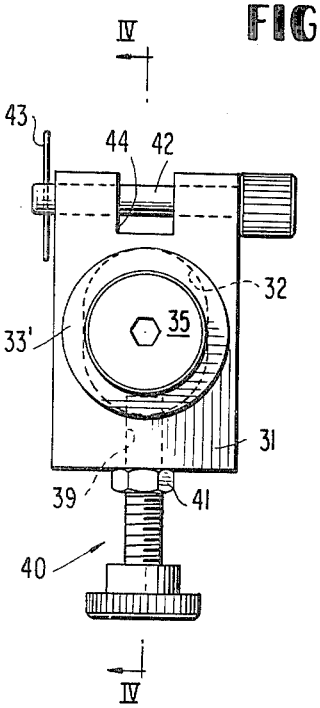
FIG. 3 is an elevational view illustrating the fine adjusting mechanism in accordance with the present invention on an enlarged scale.
Figure 4:
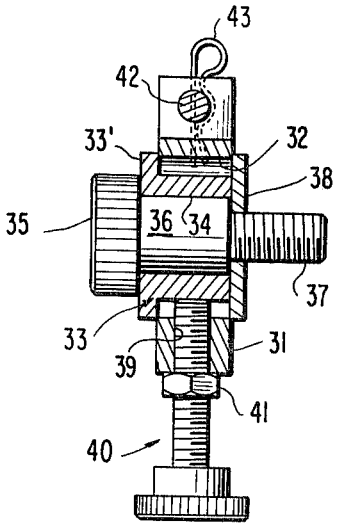
FIG. 4 is a cross-sectional view taken along line IV—IV of FIG. 3.

A common drive bar 28 is operatively connected with two eccentric drive members 29 each provided with a volume control as disclosed in the U.S. Pat. No. 2,807,213 to permit overall adjustment of the discharge stroke of all filling units. The lower end 11*b* of the piston rod 11*a* is connected with the drive bar 28 by way of a lower swivel assembly generally designated by reference numeral 30 equipped with a fine adjusting mechanism in accordance with the present invention. The lower swivel assembly 30 includes a lower swivel member 31 (FIGS. 3 and 4) of substantially rectangular configuration (FIG. 3) and provided with an elongated slot 32 extending therethrough. A circularly shaped bearing member generally designated by reference numeral 33 has a diameter slightly less than the narrow dimension of the slot 32 and includes a circularly shaped shoulder portion 33'. The bearing member 33 is provided with an internal bore 34 receiving the enlarged smooth bearing section 36 of a shoulder screw 35 having a threaded end section 37 by means of which it is secured to the common drive bar 28 by interposition of a washer 38.

The lower end of the swivel member 31 is provided with a threaded through-bore extending in the direction of the large dimension of the elongated slot 32 to receive therein a fine-adjusting screw generally designated by reference numeral 40 which depending on its adjustment projects more or less deeply into the space defined by the elongated slot 32. A lock nut 41 is provided to hold the fine adjusting screw 40 in place.

A swivel pin 42 held in place by a cotter pin 43 pivotally connects the lower end 11*b* of the piston rod 11*a* in the notch 44 provided in the upper portion of the swivel member 31.

In operation, the overall adjustment for the quantity dispensed by all filling units is at first adjusted in a conventional manner by the volume control provided on the eccentric drive assembly 29. Thereafter, if necessary, a fine adjustment is made individually for each filling unit 11 by more or less screwing the fine adjusting screw 40 into the elongated slot 32. To decrease the volume dispensed by a given filling unit, the operator merely loosens the lock nut 41, then unscrews the fine adjusting screw 40 so as to reduce its projection thereof into the elongated slot 32, as a result of which the bearing member 33 is permitted to slide back and forth a greater distance in the slot 32. This means that the lost motion between the movement of the bearing member 33 as imparted thereto by the common drive bar 28, on the one hand, and the swivel member 31 is increased the more the fine adjusting screw 40 is unscrewed out of the slot 32. Inversely, by screwing the fine adjusting screw 40 to a greater extent into the slot 32, the amount of lost motion between the bearing member 33 and the swivel member 31 during each rotation of the eccentric drive assembly 29 is decreased, thereby increasing the effective length of the piston stroke. As can be readily seen from the drawing, the fine adjustment can be made from a maximum piston stroke in which the fine adjusting screw is screwed into the slot 32 to such an extent as to substantially eliminate any sliding movement of the bearing member 33 in the slot 32 relative to the swivel member 31, to a minimum piston stroke which occurs when the fine adjusting screw 40 is screwed out so far that maximum lost motion as represented by the length of the elongated slot 32 is permitted between the bearing member 33 and the swivel member 31.

Thus, the present invention not only provides a structurally simple fine-adjustment over a relatively wide range but additionally enables this fine adjustment in an extremely simple and accurate manner, which can be installed also by merely replacing the pre-existing lower swivel assembly with the one in accordance with the present invention.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A fine adjusting mechanism for finely adjusting the volume dispensed by an individual filling unit of a filling machine having several such filling units operated in common from a common drive means, in which each filling unit includes a cylinder and a piston carried by a piston rod and operable to reciprocate within the cylinder to provide a suction and discharge stroke, and in which said common drive means comprises a common drive bar for connection with the piston rods of said individual filling units, eccentric drive means, and connecting means drivingly connecting said eccentric drive means with said common drive bar to convert the rotary movement of the eccentric drive means into reciprocating movement of the pistons by way of said common drive bar and the piston rods including common volume-adjusting means in said connecting means for adjusting simultaneously the volume of all filling units connected with said common drive bar, characterized in that each piston rod is operatively connected with the common drive bar by way of its own adjustable lost motion connecting means which is operable to provide a lost motion between two relatively movable members transmitting the driving movement from the common drive bar to the piston rod of a respective filling unit, and fine adjusting means for selectively adjusting the lost motion possible between said two relatively movable members to thereby provide an individual fine volume adjustment for each filling unit in addition to the simultaneous volume adjustment for all the filling units connected with said common drive bar by said common volume-adjusting means.

2. A fine adjusting mechanism according to claim 1, characterized in that one of said members is pivotally connected with said piston rod and the other member is drivingly connected with the common drive bar.

3. A fine adjusting mechanism according to claim 2, characterized in that said one member is a swivel member pivotally connected with the piston rod of the respective filling unit and provided with an elongated aperture, the other member being a connecting member connected to said common drive bar and having a bearing section of such dimension as to be operable to slide back and forth in said elongated aperture.

4. A fine adjusting mechanism according to claim 1, 2 or 3, characterized in that said fine adjusting means includes a screw adapted to be screwed into the path of the other member during its to and fro sliding movements so as to limit the extent of travel thereof from minimum stroke of the piston with a maximum lost motion corresponding to the length of the elongated aperture to a maximum stroke of the piston corresponding to essentially no lost motion.

5. A fine adjusting mechanism according to claim 4, characterized in that said adjusting screw is threadably screwed into said one member substantially in the direction of the length of the elongated aperture to thereby limit the relative movement between said two members depending on the extent of projection of said screw into said elongated aperture.

* * * * *